US007845695B2

(12) United States Patent
Eyton

(10) Patent No.: US 7,845,695 B2
(45) Date of Patent: Dec. 7, 2010

(54) WASTE COLLECTION DEVICE

(76) Inventor: Susan R. Eyton, 4461 Lafayette La., Spring Park, MN (US) 55384

( * ) Notice: Subject to any disclaimer, the term of this patent is extended or adjusted under 35 U.S.C. 154(b) by 0 days.

(21) Appl. No.: 12/250,279

(22) Filed: Oct. 13, 2008

(65) Prior Publication Data

US 2010/0090483 A1 Apr. 15, 2010

(51) Int. Cl.
*A01K 29/00* (2006.01)
*E01H 1/12* (2006.01)

(52) U.S. Cl. ..... 294/1.4; 294/55

(58) Field of Classification Search ..... 294/1.1, 294/1.3, 1.4, 1.5, 55; 15/257.1, 257.2, 171; 119/161

See application file for complete search history.

(56) References Cited

U.S. PATENT DOCUMENTS

| | | | | | |
|---|---|---|---|---|---|
| 50,610 | A | * | 10/1865 | Miller | 15/171 |
| 209,017 | A | * | 10/1878 | Boult | 15/171 |
| 335,808 | A | * | 2/1886 | Gallagher | 15/171 |
| 336,169 | A | * | 2/1886 | Stephen | 15/171 |
| 428,665 | A | * | 5/1890 | Clyde et al. | 15/171 |
| 2,141,007 | A | | 12/1938 | Meeh | |
| 2,546,113 | A | * | 3/1951 | Everette | 294/1.1 |
| 3,052,214 | A | | 9/1962 | Johnson | |
| 3,778,097 | A | * | 12/1973 | Dorzan | 294/1.4 |
| 3,804,448 | A | | 4/1974 | Schmieler | |
| 3,809,421 | A | * | 5/1974 | James | 294/50.8 |
| D234,304 | S | * | 2/1975 | Schmieler | D30/162 |
| 4,148,513 | A | * | 4/1979 | Gagne | 294/1.4 |
| 4,165,895 | A | * | 8/1979 | Bacoka | 294/1.4 |
| 4,231,602 | A | * | 11/1980 | Kinney | 294/1.4 |
| 4,349,224 | A | * | 9/1982 | Shiozaki | 294/1.4 |
| 4,686,734 | A | * | 8/1987 | Alexander | 15/257.1 |
| D291,863 | S | | 9/1987 | Kolonia | |
| 4,896,912 | A | * | 1/1990 | Parnell | 294/1.3 |
| 5,039,149 | A | * | 8/1991 | Gish | 294/1.4 |
| 5,502,871 | A | * | 4/1996 | Reyes | 15/257.1 |
| D385,160 | S | | 10/1997 | Tisbo et al. | |
| 5,832,563 | A | * | 11/1998 | Simpson | 16/110.1 |
| 5,899,510 | A | * | 5/1999 | Hayes et al. | 294/1.4 |
| 6,131,972 | A | | 10/2000 | Whitehead et al. | |
| 6,554,335 | B1 | | 4/2003 | Kelly et al. | |
| 6,926,629 | B2 | | 8/2005 | Dehen | |
| 7,118,145 | B1 | | 10/2006 | Rosine et al. | |
| 7,216,403 | B2 | | 5/2007 | Decker | |
| 2004/0145196 | A1 | | 7/2004 | Katz | |
| 2004/0189027 | A1 | * | 9/2004 | Warn et al. | 294/1.4 |
| 2005/0184540 | A1 | | 8/2005 | Graziosi | |

FOREIGN PATENT DOCUMENTS

| | | | |
|---|---|---|---|
| DE | 3325696 | * | 1/1985 |

* cited by examiner

*Primary Examiner*—Dean J Kramer
(74) *Attorney, Agent, or Firm*—Allison Johnson, P.A.

(57) ABSTRACT

The disclosure describes a waste collection device that includes a sweep that includes a plate and a first handle, and a scoop that includes a receptacle and a second handle. The first handle is attached to the plate and the second handle is attached to the receptacle. The disclosure also describes a method of picking up animal waste that includes contacting the waste with the plate of a sweep and sweeping the waste into a receptacle of a scoop through an opening of the receptacle.

20 Claims, 5 Drawing Sheets

WASTE COLLECTION DEVICE

BACKGROUND

The invention relates to collecting waste, e.g., the solid waste of an animal.

Animal and pet owners are often faced with the task of cleaning up the solid waste (e.g., feces) created by their animals. This task, although necessary, can be quite distasteful. The waste often has an unpleasant aroma and is not aesthetically pleasing.

A number of solutions have been developed to ease this task. These solutions range from professional services that, for a fee, will come and remove the feces from the desired area (e.g., a yard) to shovels and plastic baggies, which the user uses to pick up the feces. Shovels and two component collectors have been used for this purpose. When using a shovel, for example, the feces is visible on the surface of the shovel, and it is difficult to maintain one piece of feces on the face of the shovel when trying to pick up a second piece of feces.

Existing waste collection devices also are often heavy, cumbersome and difficult to operate. Frequently it is also difficult to empty the device. In one waste collecting device, a rake-like portion is used to push the feces into a receptacle generally configured in the shape of a dust pan. The feces often sticks to the tines of the rake. The dust pan typically cannot hold a large volume of feces, is difficult to empty, and feces can be seen from the top by the user looking down. These devices also are difficult to clean as the feces often sticks in the corners and surfaces of the dust pan.

There is a need for a light weight easy to use feces collector that can be easily emptied and hides the distasteful waste from view during the feces collection process.

SUMMARY

In one embodiment, the invention features a waste collection device that includes a sweep and a scoop that includes a receptacle. In one embodiment, the scoop includes a cylindrical receptacle that includes at least one side wall and an opening, the at least one side wall defining the opening.

In some embodiments, the receptacle is of a construction such that when waste is disposed in the receptacle, it is not visible to a user standing upright, holding the handle of the receptacle and looking downward toward the receptacle.

In other embodiments, the opening of the receptacle defines a diameter of at least about 5 inches. In another embodiment, the opening of the receptacle defines a diameter of from about 5.5 inches to about 7.5 inches.

In some embodiments, the plate is in the shape of a polyhedron. In other embodiments, the plate is rectangular. In one embodiment, the plate includes a working surface and a major portion of the working surface is flat.

In another embodiment, at least one of the first handle and the second handle includes a shaft having a rectangular cross section. In other embodiments, at least one of the handle, the plate and the receptacle includes wood, plastic, metal, or a combination thereof.

In one embodiment, at least one of the first handle and the second handle includes a shaft having a height of at least 24 inches.

In another aspect, the invention features a method of picking up animal waste, the method including contacting the waste with the plate of a sweep, the sweep that includes the plate and a first handle, and sweeping the waste into a receptacle of a scoop through an opening of the receptacle, the receptacle that includes at least one side wall defining the opening, the scoop that includes the receptacle and a second handle.

In one embodiment, the at least one side wall forms a continuous side wall.

In another embodiment, the method further includes carrying the first handle in the hand of a user, resting a portion of the first handle against a first forearm of the user, and resting a portion of the second handle against a second forearm of the user. In some embodiments, at least one of the first handle and the second handle comprises a shaft having a rectangular cross section.

In another aspect, the invention features a waste collection device that includes a sweep that includes a continuous polygonal-shaped plate and a first handle that includes a longitudinal extent of at least 24 inches, and a scoop that includes a cylindrical receptacle and a second handle that includes a longitudinal extent of at least 24 inches, the receptacle that includes at least one side wall defining an opening and a back wall, the second handle being attached to the back wall of the receptacle. In some embodiments, at least one side wall of the receptacle is continuous.

The invention features a waste collection device that can be constructed to block the collected feces from the view of the user and to receive more than one feces deposit, which enables a more efficient waste removal process. The waste collection device can be used to remove feces from a grassy area without leaving a significant portion of the feces on the grass surface.

The handles of the device can be constructed to enable the handles of the collector to rest on the forearms of the user while the user walks around the area being cleaned, which facilitates and eases carrying the device. In such a position, the components of the device do not sway and swing while being transported. The handles of the device can also be constructed to enable the user to use and manipulate the components of the waste collection device with ease.

Other features and advantages will be apparent from the brief description of the drawings, from the following description of the preferred embodiments, and from the claims.

DETAILED DESCRIPTION

Figures 1, 2:
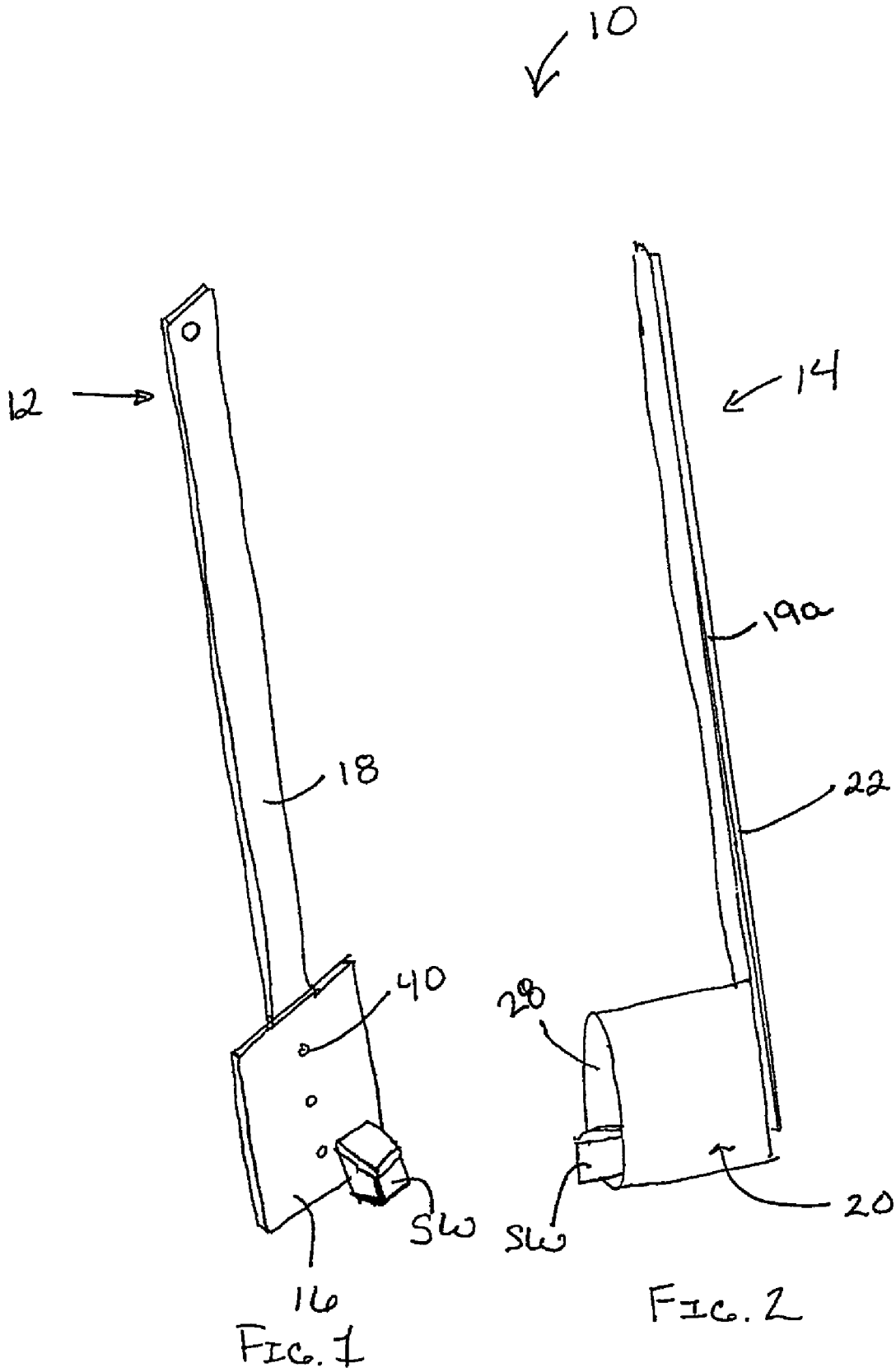
FIG. 1 is a perspective view of the sweep of a waste collection device.
FIG. 2 is a perspective view of the scoop of a waste collection device.
Figure 5:
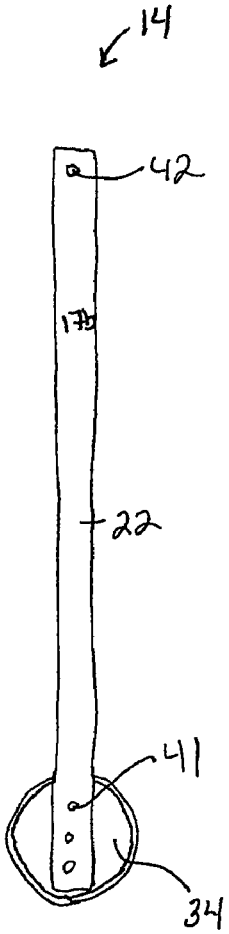
FIG. 5 is a plane view of the back of the scoop of FIG. 2.
Figure 3:
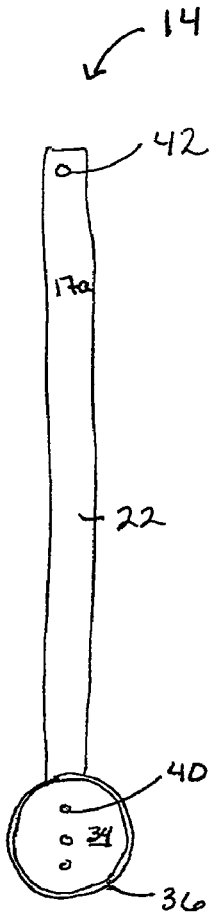
FIG. 3 is a plane view of the front of the scoop of FIG. 2.
Figure 4:
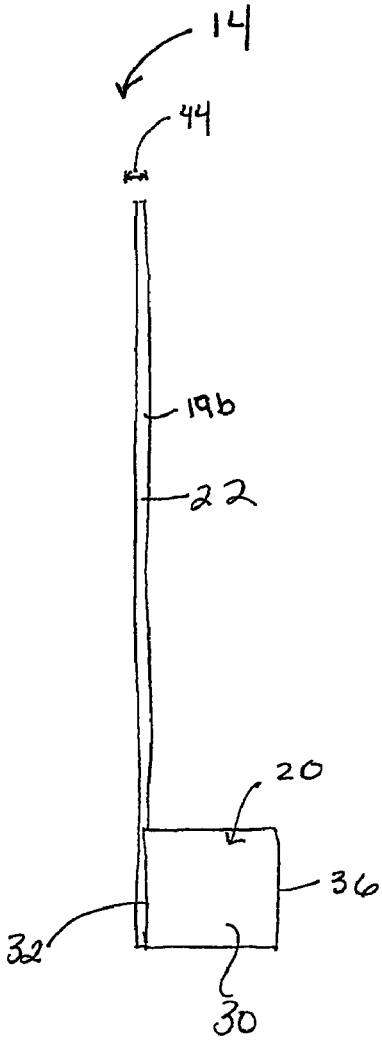
FIG. 4 is a plane view of the side of the scoop of FIG. 2.
Figure 8:
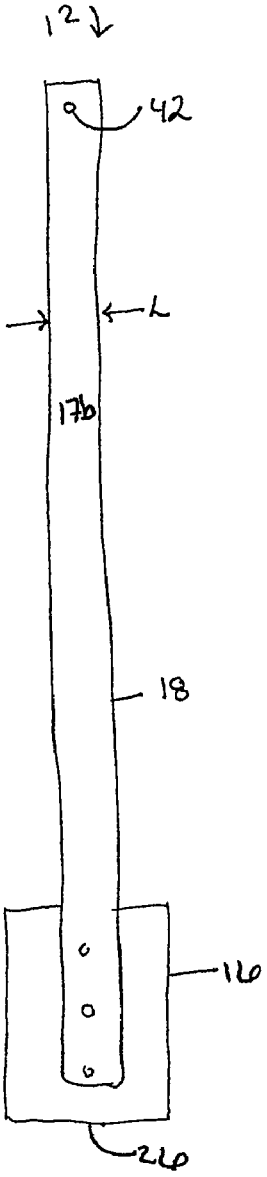
FIG. 8 is a plane view of the back of the sweep of FIG. 1.
Figure 6:
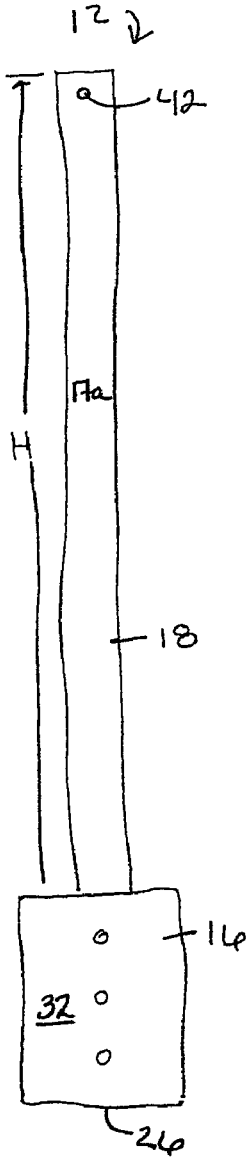
FIG. 6 is a plane view of the front of the sweep of FIG. 1.
Figure 7:
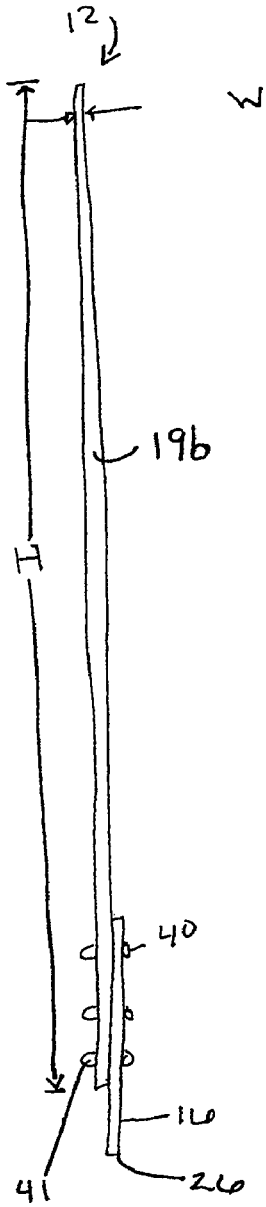
FIG. 7 is a plane view of the side of the sweep of FIG. 1.

FIGS. 1-8 depict a waste collection device 10 that includes a sweep 12 and a scoop 14. The sweep 12 includes a plate 16 attached to a handle 18, which is in the form of an elongated shaft, by screws 40, which are held in place by nuts 41. The scoop 14 includes a receptacle 20 attached to a handle 22, which is in the form of an elongated shaft, by screws 40, which are held in place by nuts 41.

In use, the sweep 12 and scoop 14 of the waste collection device 10 are held in separate hands by a user. The user grasps the handles 18, 22 in each hand and moves the plate 16 of the sweep 12 against a piece of solid waste SW (e.g., feces) in a manner sufficient to transfer the waste to the receptacle 20. The sweep 12 can be manipulated in any manner suitable for achieving the transfer of the waste SW into the receptacle 20 including, e.g., a sweeping, flicking and scraping motions, and combinations thereof. The plate 16 is pressed against the surface on which the waste SW lies near the location of the waste SW. In a grass yard, for example, the leading edge 26 of the plate 16 is pressed against the grass so as to press the grass down into the earth. The plate 16 is then flicked using a quick hand and wrist motion so as to dislodge the waste from the grass and send it sailing into the receptacle 20. When carrying the waste collection device 10 from one waste location to another, the user can rest a portion of the handles 18, 22 on his or her forearms as partially illustrated in FIG. 12.

The receptacle 20 is dimensioned to easily receive waste from the plate 16. The opening 28 of the receptacle 20 is sufficiently large to enable the waste to pass into the receptacle without being caught on the edge (i.e., rim) of the receptacle. FIGS. 2 and 3-5 depict an embodiment in which the receptacle 20 is in the form of a cylinder 30 that is closed on one end 32 with an end wall 34 and open on the opposite, waste receiving end 36. The handle 22 of the scoop 14 is attached to the end wall 34 of the closed end 32 of the cylinder 30 through screws 40. The opening 28 on the waste receiving end 36 of the receptacle 20 is circular. The side wall that forms the cylinder 30 of the receptacle 20 is continuous such that items contained within the receptacle 20 are not visible to a user holding the handle in his or her hand and standing upright and looking downward toward the receptacle. In other embodiments, the side wall can be discontinuous, e.g., the side wall can include openings of a variety of shapes including, e.g., slots (e.g., linear slots), circular, polygonal, elliptical, and combinations thereof.

Useful receptacles include an opening 28 for receiving waste that has a cross sectional dimension (e.g., a diameter) of at least about 4 inches, at least about 5 inches, at least about 5.5 inches, from about 4 inches to about 10 inches, or even from about 5 inches to about 8 inches.

For ease of reference, the receptacle 20 will be described as having one side wall; however, it is to be understood that the receptacle 20 can be defined by more than one side wall. The side wall that defines the opening 28 of the receptacle 20 and the end wall 34 preferably are sufficiently rigid so as to prevent complete collapse of the receptacle when the bottom surface of the receptacle is pressed against the surface on which the waste lies. The receptacle preferably is made out of a rigid material. In some embodiments, the side walls exhibit a degree of flex (e.g., bending).

The portion of the side wall of the receptacle that defines the opening (i.e., the rim) is preferably sufficiently thin so as not to interfere with the collection of the waste. The receptacle can optionally include a lip at the opening. If a lip is present, it preferably is constructed so as not to interfere with the smooth transfer of waste into the receptacle. The side wall can have any suitable thickness including a thickness of from about 0.01 inch to about 0.1 inch, from about 0.01 inch to about 0.08 inch, or even from about 0.03 inch to about 0.05 inch.

The plate 16 of the sweep 12 preferably is sufficiently rigid and inflexible that it does not bend significantly when encountering the resistance a typical animal solid waste would represent. The plate 16 includes a continuous (i.e., is free of visible openings), smooth flat surface (as determined by the touch of an individual). In other embodiments, the plate includes openings. Preferably the plate 16 is made out of a stiff, rigid material, suitable examples of which include metal (e.g., aluminum). The surface area of the working surface 32 (i.e., the side of the plate that faces the opening of the scoop in use and that is designed to contact the waste) of the plate 16 can be of any suitable dimension. The plate 16 preferably includes a sufficient amount of surface area on the working surface 32 thereof to move the waste from its resting position. Useful plate 16 dimensions include, e.g., a height of from about 4 inches to about 12 inches, from about 6 inches to about 10 inches, from about 7 inches to about 9 inches, or even about 8 inches, and a length of from about 2 inches to about 10 inches, from about 4 inches to about 8 inches, from about 5 inches to about 7 inches, or even about 6 inches.

The handles 18, 22 include an elongated shaft of sufficient rigidity to enable the sweep and scoop movements to be carried out and manipulated by the user with ease and effectiveness. The shafts of handles 18, 22 include two flat major surfaces 17*a*, 17*b* and two flat minor surfaces 19*a*, 19*b*. In other embodiments, the surfaces of the shaft can be other than flat and can include at least a portion that includes components to aid gripping by the hand. Examples of useful gripping mechanisms include bumps, ridges (e.g., lateral ridges), elastomeric material (e.g., rubber and thermoplastic elastomer), and combinations thereof. The bumps can exhibit a surface that is smooth to the touch (e.g., rounded), or rough. The bumps can be of a variety of dimensions and shapes including, e.g., circular, elliptical, oval, pyramidal, polygonal, and combinations thereof. In other embodiments, the shafts are cylindrical or polyhedron in shape.

Figure 12:
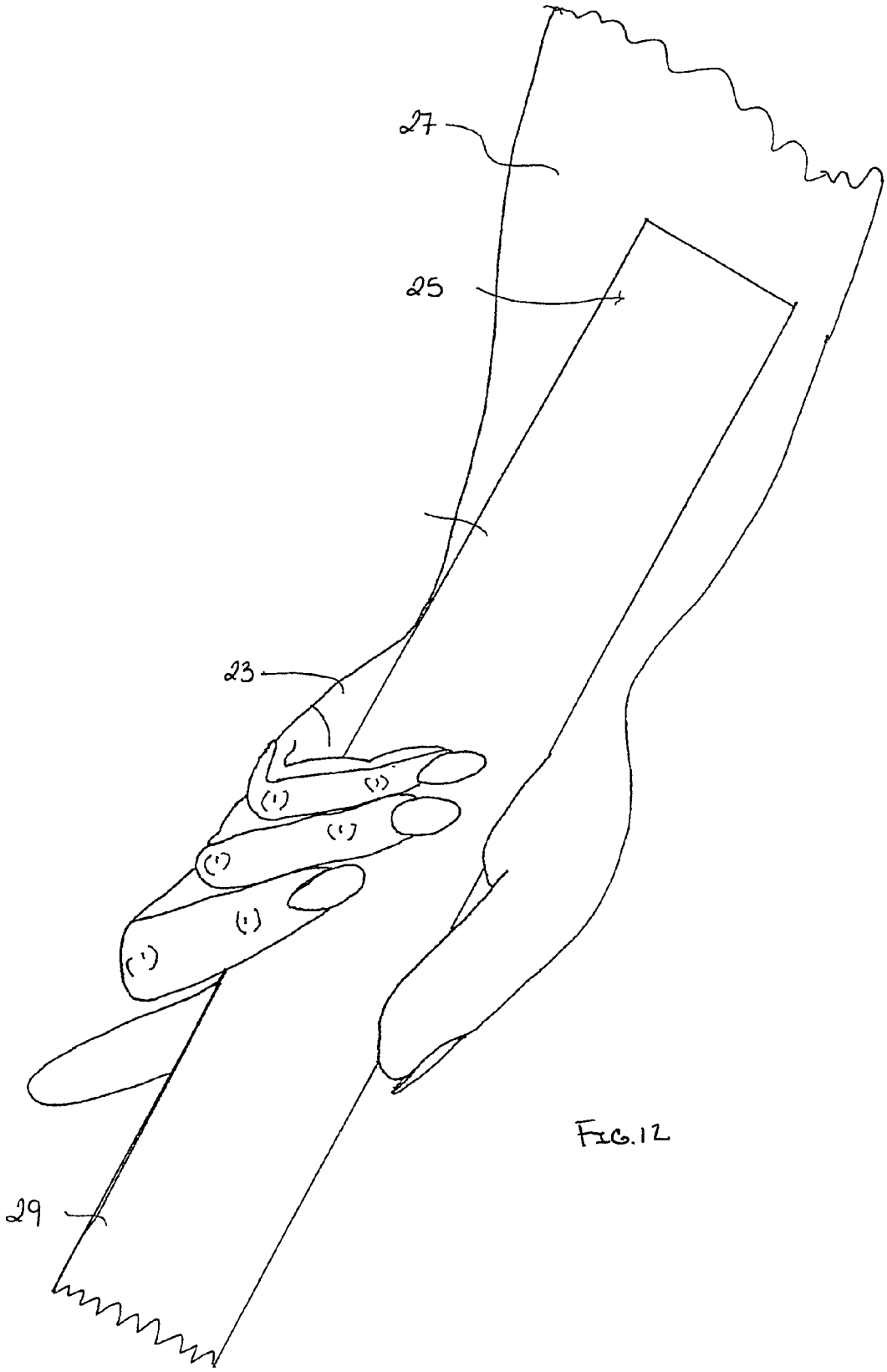
FIG. 12 is a perspective view of the handle of the scoop of FIG. 2 resting on the forearm of a user.

In one embodiment, the handles 18, 22 are of a height such that an end portion of each handle rests on the user's forearms while a major longitudinal extent of the handle extends downward, away from the user's hand and toward the ground. FIG. 12 illustrates the handle 22 of the scoop 14 in the grasp of the left hand 23 of a user. The end portion 25 of the handle rests on the user's left forearm 27 and a major portion 29 of the longitudinal extent of the handle 22 extends downward, away from the user's hand 23. The handle height can be selected based on the user's height. The handles 18 and 22 of the sweep 12 and the scoop 14 are preferably of a height sufficient to enable the user to remain substantially upright when collecting waste. Examples of useful handle heights include from about 30 inches to about 50 inches, from about 35 inches to about 45 inches, or even from about 35 inches to about 40 inches.

The handles 18, 22 are also dimensioned to rest comfortably in the user's hands. The handles 18, 22 can also be of any suitable length and width to enable the handle to fit within the grasp of a hand. Useful handles have a length of from about 1 inch to about 3 inches, from about 1.5 inches to about 2.5 inches, or even about 2 inches, and a width of from about 0.1 inch to about 1.5 inch, or even from about 0.15 inch to about 1 inch, or even from about 0.2 inch to about 0.5 inch.

In other embodiments, the handles include additional handle grip components to facilitate gripping and movement of the handle. Examples of handle grip components and enhanced gripping mechanism are described in U.S. Pat. Nos. 7,118,145, 6,131,972, 7,216,403, 7,416,499, 7,418,892, D385,160, and D291,863 and incorporated herein.

The handles 18, 22 are attached to the plate 16 of the sweep 12 or the receptacle 20 of the scoop 14, respectively, either directly or indirectly, e.g., other components can be positioned between the handle and the receptacle or plate.

FIGS. 1, 3, 5, 6 and 8 illustrate handles 18, 22 that include holes 42 that extend through the width 44 of the handle 18, 22. The holes 42 enable the sweep and the scoop to be easily stored on a hanging element, e.g., a nail or a hook.

The handles 18, 22 can be fabricated as a single unit with their respective plate and receptacle or as individual components that are then attached together. The handles 18, 22 can be attached to their respective plate and receptacle using any suitable mechanism including, e.g., mechanical devices (e.g., screws, nails, clips, staples, and male female connectors), adhesive compositions, sonic weld, thermal weld, and combinations thereof.

The receptacle, plate, and handles of the waste collection device can be made from a variety of materials. Preferably the material is sufficiently rigid such that the handles and plate will not flex significantly when encountering waste during the sweeping action. Useful materials include, e.g., wood, metal (e.g., steel, aluminum, copper, metal alloys and combinations thereof), graphite, plastic, composites, and minerals (e.g., rock, marble, granite, and combinations thereof), and combinations thereof. Useful plastics include, e.g., thermoplastic and thermoset polymers including, e.g., polypropylene, polyethylene, polystyrene, elastomers, biodegradable polymers (e.g., polylactic acid-based polymers), compostable polymers, and combinations thereof. Useful composites include composites of polymer in combination with wood, fiber (e.g., cellulosic and polymeric), metal, glass (e.g., glass beads and glass bubbles), stone, silica, and combinations thereof, fiberglass composites, and combinations thereof. The handles, receptacle and plate can be made out of the same or different materials.

The waste collection device 10 is useful in a variety of environments including, e.g., yards, zoos, playgrounds, parks, feed lots, farms, and animal processing facilities.

In some embodiments, the waste collection device is a packaged article that includes the sweep and the scoop maintained as a unit with packaging. The packaged article can include any suitable packaging for maintaining the sweep and scoop as a unit including, e.g., clips, binders, rubber bands, ties, polymer film, cardboard, container (e.g., box or bag), adhesive composition and articles, and combinations thereof.

Other embodiments are within the claims. Although the receptacle is depicted as cylindrical, the receptacle (e.g., the walls and the opening of the receptacle) can define any of a variety of shapes including, e.g., sphere, ellipse, oval, polyhedron (e.g., cube, prism, pyramid, tetrahedron, pentahedron, hexahedron, octahedron, decahedron, parallelepiped (e.g., rhombohedron), and diamond), hemisphere, arcuate terminated cylinder, cone, frusto-conical cone, a body having opposed polygonal faces including, e.g., triangle, square, rectangle, rhomboid, pentagon, hexagon, heptagon, and octagon faces, a body exhibiting the shape of a gumdrop or a bell, a polyhedron (i.e., a geometric body with flat faces and straight edges), and combinations thereof.

Figure 9:
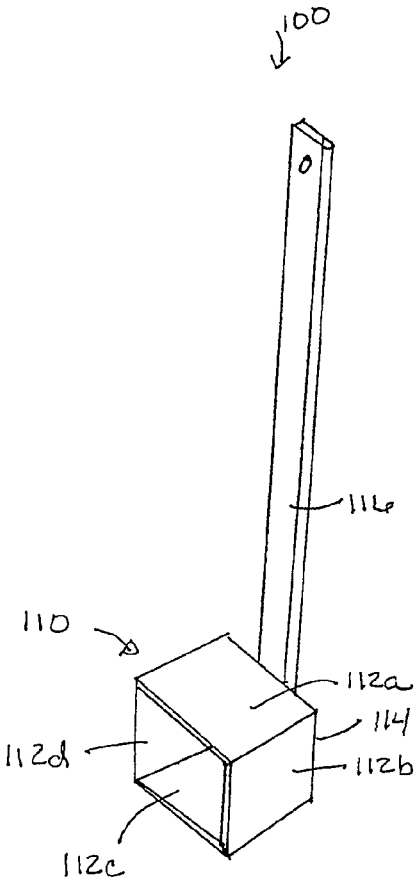
FIG. 9 is a perspective view of a scoop of a waste collection device according to another embodiment.

FIG. 9 illustrates an embodiment of a scoop 100 that includes a receptacle 110 in the form of a polygonal-shaped body defined by four rectangle-shaped side walls 112*a*-112*d* and a back wall 114, and a handle 116 attached to the back wall 114 of the receptacle 110.

Figure 10:
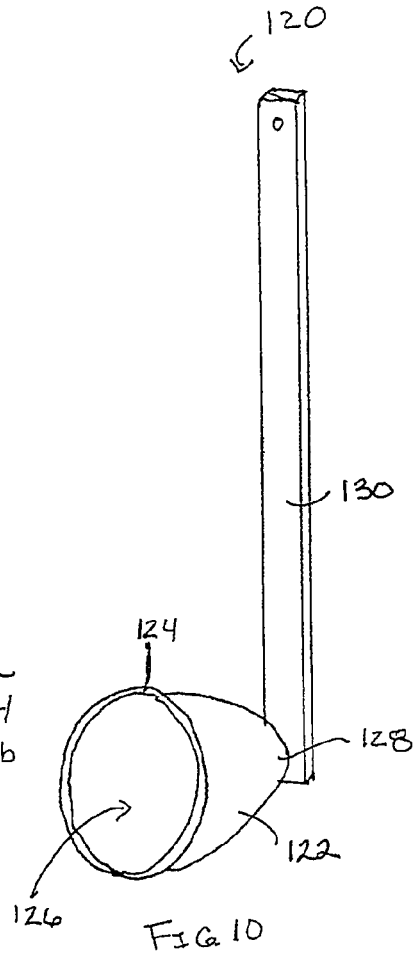
FIG. 10 is a perspective view of a scoop of a waste collection device according to another embodiment.

FIG. 10 illustrates an embodiment of a scoop 120 that includes an arcuate truncated cone-shaped receptacle 122 that includes a rim 124, which defines an opening 126 and a handle 130 attached at the apex 128 of the arcuate truncation of the receptacle 122.

Figure 11:
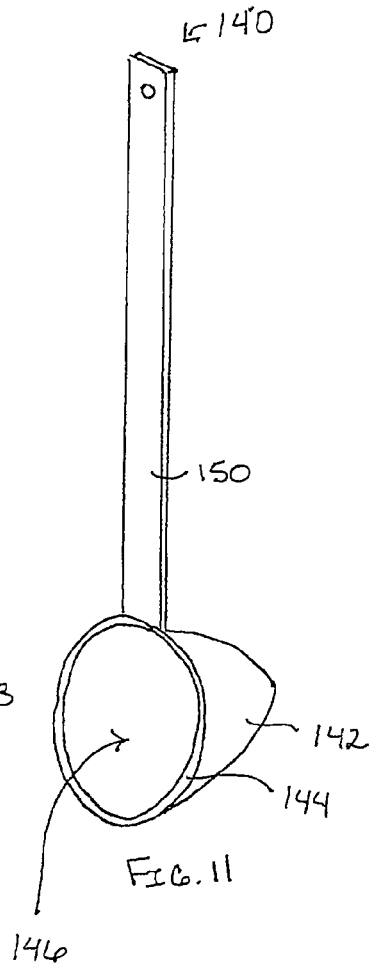
FIG. 11 is a perspective view of a scoop of a waste collection device according to another embodiment.

FIG. 11 illustrates an embodiment of a scoop 140 that includes an arcuate truncated cone-shaped receptacle 142 that includes a rim 144, which defines an opening 146 and a handle 150 attached to the rim 144 of the receptacle 142.

Although the handles of the sweep and scoop are illustrated in FIGS. 1-11 as being flat and having a rectangular shape in cross section, the handles can exhibit any suitable shape in cross section including, e.g., circle, ellipse, oval, and arcuate. The perimeter of the handles can also define a variety of shapes including, e.g., sphere, hemisphere, ellipse, oval, arc, polyhedron (e.g., cube, prism, pyramid, tetrahedron, pentahedron, hexahedron, octahedron, decahedron, parallelepiped (e.g., rhombohedron), and diamond), arcuate terminated cylinder, cone, frusto-conical cone, a body having opposed polygonal faces including, e.g., triangle, square, rectangle, rhomboid, pentagon, hexagon, heptagon, and octagon faces, a body exhibiting the shape of a gumdrop or a bell, and combinations thereof.

Although the waste collection device has been described with respect to collecting animal waste, the collector can be used to collect a variety of waste products and other articles including, e.g., trash, leaves, rocks, twigs, fruit (e.g., apples, cherries, peaches, oranges, and plums), nuts, acorns, walnuts, buckeyes, horse chestnuts, shells, and combinations thereof.

In some embodiments at least one surface of the waste collection device (e.g., the interior surface of the receptacle, the waste-contacting surface of the plate, and combinations thereof) can be coated with a composition that enables the easy release of the waste (e.g., feces) from the surface and easy cleaning of the receptacle (e.g., a non-stick coating). Examples of such coating compositions include fluoropolymers, one commercially available example of which is TEFLON polytetrafluoroethylene (which is commercially available from E. I. du Pont de Nemours and Company (Wilmington, Del.)), and silicones.

What is claimed is:

1. A waste collection device comprising:

a sweep comprising a continuous plate and a first handle attached to the plate, the sweep being free of bristles, the plate comprising a first major surface, and a second major surface opposite the first major surface, the first handle having a longitudinal extent and being attached to the second major surface of the plate such that the longitudinal extent of the first handle is in parallel with the second major surface of the plate; and a rigid scoop comprising a receptacle comprising a cylinder comprising an opening having a diameter of at least about 5 inches, at least one side wall defining the opening and the cylinder, and a back wall positioned opposite the opening, and a second handle attached to the back wall of the receptacle, the second handle having a longitudinal extent in parallel with the back wall of the receptacle.

2. The waste collection device of claim 1, wherein the receptacle is of a construction such that when waste is disposed in the receptacle, it is not visible to a user standing upright, holding the handle of the receptacle and looking downward toward the receptacle.

3. The waste collection device of claim 1, wherein the opening of the receptacle defines a diameter of from about 5.5 inches to about 7.5 inches.

4. The waste collection device of claim 1, wherein the plate is in the shape of a polyhedron.

5. The waste collection device of claim 1, wherein the plate is rectangular.

6. The waste collection device of claim 1, wherein the plate comprises a working surface and a major portion of the working surface is flat.

7. The waste collection device of claim 1, wherein at least one of the first handle and the second handle comprises a shaft having a rectangular cross section.

8. The waste collection device of claim 1, wherein at least one of the handle, the plate and the receptacle comprises wood, plastic, metal, or a combination thereof.

9. The waste collection device of claim 1, wherein at least one of the first handle and the second handle includes a shaft having a height of at least 24 inches.

10. The waste collection device of claim 1, wherein the first handle further comprises a first surface, a second surface opposite the first surface, and an opening extending through the handle from the first surface to the second surface.

11. A method of picking up animal waste, said method comprising:

contacting the waste with a first major surface of a continuous plate of a sweep of a waste collection device; and sweeping the waste into a cylinder of a scoop, the waste collection device comprising the sweep, which comprises the continuous plate and a first handle attached to the plate, the plate comprising the first major surface, and a second major surface opposite the first major surface, the first handle having a longitudinal extent and being attached to the second major surface of the plate such that the longitudinal extent of the first handle is in parallel with the second major surface of the plate; and a scoop comprising a receptacle comprising an opening comprising a circular having a diameter of at least about 5 inches, at least one side wall defining the opening and the cylinder, and a back wall positioned opposite the opening, and a second handle attached to the back wall of the receptacle, the second handle having a longitudinal extent in parallel with the back wall of the receptacle.

12. The method of claim 11, wherein the receptacle is of a construction such that when waste is disposed in the receptacle, it is not visible to a user standing upright, holding the handle of the receptacle and looking downward toward the receptacle.

13. The method of claim 11, wherein the opening of the receptacle defines a diameter of from about 5.5 inches to about 7.5 inches.

14. The method of claim 11, wherein the plate is in the shape of a polyhedron.

15. The method of claim 11, wherein the plate is rectangular.

16. The method of claim 11, wherein the plate comprises a working surface and a major portion of the working surface is flat.

17. The method of claim 11, wherein at least one of the first handle and the second handle comprises a shaft having a rectangular cross section.

18. The method of claim 11, wherein at least one of the handle, the plate and the receptacle comprises wood, plastic, metal, or a combination thereof.

19. The method of claim 11, wherein at least one of the first handle and the second handle includes a shaft having a height of at least 24 inches.

20. The method of claim 11, wherein the first handle further comprises a first surface, a second surface opposite the first surface, and an opening extending through the handle from the first surface to the second surface.

* * * * *